US005333367A

United States Patent [19]

Ashbrook

[11] Patent Number: 5,333,367

[45] Date of Patent: Aug. 2, 1994

[54] BULLET PULLER

[75] Inventor: Clifford L. Ashbrook, Spicewood, Tex.

[73] Assignee: Quin Tics Corporation, San Antonio, Tex.

[21] Appl. No.: 967,214

[22] Filed: Oct. 27, 1992

[51] Int. Cl.[5] ..... B25B 27/14

[52] U.S. Cl. ..... 29/275

[58] Field of Search ..... 86/49; 29/275, 276, 29/243, 254, 255, 282; 81/19, 20; 254/26 R

[56] References Cited

U.S. PATENT DOCUMENTS 3,253,329 5/1966 Lehn ..... 29/275
3,646,661 3/1972 Ashbrook ..... 86/49
5,062,324 11/1991 Saviano ..... 81/20

*Primary Examiner*—Robert C. Watson
*Attorney, Agent, or Firm*—Donald R. Comuzzi

[57] ABSTRACT

The present invention is an inertial bullet puller comprising a rigid tough transparent plastics material carrier tube having an opening at its upper end adapted to receive a cartridge and a head portion at its lower end adapted to be struck against a hard surface. The carrier tube is affixed to the end of a handle in a manner similar to the construction of a hammer. However, the carrier tube is not completely perpendicular to the handle, but instead, resides at an angle to the handle. At the upper end of the carrier tube is disposed an annular segmented cartridge support. A cap at the upper end of the carrier tube having a tapered inner end provides a cam surface for positively moving the annular segmented cartridge support radially inwardly and holding it in position. When a cartridge is inserted through the annular segmented cartridge support into the opening at the upper end of the tube, the cartridge support expands to pass the larger diameter portions of the cartridge, and then as the cap is tightened, the cartridge support contracts into the cannelure. In use the lower end of the tube is struck once or twice against a hard surface until the bullet is observed to pull free of the cartridge case. The lower end of the tube is closed forming a pocket to receive the bullet and case contents when the bullet is freed from the case. Tapered surfaces on the interior of the cartridge support allows the cartridge support to move radially outward when the cap is backed off, and the cartridge components are shaken out of the upper end of the carrier tube.

10 Claims, 2 Drawing Sheets

BULLET PULLER

BACKGROUND OF THE INVENTION

1. Field of the Invention

The present invention relates to inertial bullet pullers which are devices utilized to remove the bullet from the case of cartridge type round of ammunition. Inertial bullet pullers operate by first imparting a rapid motion to the cartridge and then bringing the case thereof to a quick stop. When the case slows down it tries to slow down the bullet too, thereby imposing tension on the connection between the bullet and case. If the tension force is great enough the connection parts, which is the desired result. The tension force is proportional to the time rate of change in the momentum of the bullet and for any given bullet mass is proportional to the time rate of change in bullet velocity. The latter depends on the initial velocity of the bullet and upon the length of time required to stop it, which in turn depends on the speed of propagation of the elastic shock wave through the material carrying the cartridge case.

2. Discussion of the Prior Art

Prior art inertial bullet pullers include a rigid cartridge carrier in the form of a transparent, plastics material tube having an opening at one end adapted to receive a cartridge and provided at its other end with a head portion adapted to be struck against a hard surface. A cartridge support is provided at the one end of the carrier tube for engaging the cannelure or other portion of the cartridge case. The head end of the carrier tube extends beyond the nose of the bullet and is closed with its interior being tapered at the lower end.

In use, a cartridge is placed in the carrier tube and supported therein by the cartridge support which engages the cannelure. A securing cap is provided for holding the cartridge support to the end of the carrier. The head portion at the end of the carrier tube is repeatedly struck against a hard surface such as the top of a table until the bullet pulls free of the case. To facilitate accelerating the carrier to a high velocity and striking it against a fixed hard surface the carrier is provided with a handle extending transversely from the carrier tube. The resulting carrier and handle combination has the overall shape of a hammer.

Prior art bullet pullers employ catridge supports in the form of an open-sided washer which extends from the top of the cartridge carrier to underneath the upper side of the cannelure when the puller is in use. A snug-fitting polyethylene cap is slipped over the upper end of the carrier and frictionally engages the carrier tube and holds the washer and cartridge in place. Such a cartridge support is the source of some difficulty because a plurality of support washers having differing inner diameters must be employed in order to accommodate cartridges having different diameter cannelures. Also, after each use it is necessary to pull the tight-fitting cap off the end of the carrier.

Another form of cartridge support employed by prior art bullet pullers consists of a U-shaped plate which has a variable width between its tines in order to adapt it to cannelures of different diameters. However, such a cartridge support has so little area of engagement with the cannelure that it readily shears if the carrier is struck too hard.

An improvement over the above inertial bullet pullers is disclosed in my U.S. Pat. No. 3,646,661, the disclosure of which is herein incorporated by reference. According to my prior inertial bullet puller, an annular segmented support is provided at the upper end of the carrier of the bullet puller which is extendable into and retractable from the cannelure of a cartridge placed therein. Additionally, the annular segmented support is configured to fit a wide range of cartridges having cannelures of different diameters. The annular segmented support comprises a plurality of arcuate shape members or segments adapted to be annularly disposed at the upper end of a carrier. A garter spring extends around the segments providing a resilient force for urging the segments radially inwardly to an extent limited either by engagement with a cartridge or by the otherwise spaced apart sides of the segments coming into engagement. A cam surface is provided for positively urging the segments radially inwardly and holding them positioned beneath the upper wall of a cartridge cannelure. The cam surface is carried by a cap that threadably engages the upper end of the carrier tube adjacent the cannelure.

Although the inertial bullet puller disclosed in my U.S. Pat. No. 3,646,661 improved over the existing prior art, it fails to operate as easily and efficiently as desired. Under ideal conditions, the head portion of the carrier tube must strike a hard surface squarely so that the carrier tube and, thus, the cartridge from which the bullet is to be removed are perpendicular to the striking surface. That is, the force vector developed by striking the hard surface with the head portion of the carrier tube should be parallel to the axis of the cartridge from which the bullet is being extracted. If the carrier tube is not perpendicular to the surface being struck, the force vector cannot be parallel with the axis of the cartridge being disassembled which results in the bullet being extremely difficult to extract.

The inertial bullet puller in my U.S. Pat. No. 3,646,661 rarely works ideally and more often than not requires numerous raps against a hard surface—often as much as eight or more—to disengage the bullet from the case. That inertial bullet puller fails to operate easily and efficiently to remove bullets from their case because it was designed with a handle which is completely perpendicular to the carrier tube. The completely perpendicular configuration of the handle with respect to the carrier tube makes it difficult for a person using the inertial bullet puller to position his/her wrist in a manner which allows the head portion of the carrier tube to be easily struck squarely against a hard surface. Thus, because squarely striking the head portion is extremely difficult, my prior inertial bullet puller requires numerous blows to disengage the bullet from its case.

Furthermore, uncentered blows along the carrier tube head portion weakens the material used to make the carrier tube, thereby causing premature material failure. That is, when the head portion is not struck squarely, the force vector is not applied to the cartridge but rather is absorbed by the inertial bullet puller itself causing the carrier tube material to crystalize and prematurely break.

Another design deficiency not related to the handle position is that once the bullet disengages from the case, it is necessary to remove the securing cap before it may be retrieved from the carrier tube. Although the cartridge support was originally intended to part sufficiently far enough to allow the bullet to pass, it was discovered that no matter how much the carrier tube was shook or the securing cap rapped against a hard surface, the bullet would not pass and could not be removed without first removing the securing cap.

The inertial bullet puller disclosed in my U.S. Pat. No. 3,646,661, therefore, is subject to premature breakage, is rather tedious to use, and requires a notable time investment when a significant number of bullets are pulled. Such performance characteristics are less than desirable to the ordinary shooting enthusiast.

Accordingly, the present invention improves over the prior art and especially my U.S. Pat. No. 3,646,661 by solving the above problems.

SUMMARY OF THE INVENTION

The present invention improves over the prior art including my U.S. Pat. No. 3,646,661 by employing a reconfigured handle and a redesigned annular segmented support. The handle has been improved by altering its angle with respect to the carrier tube. Specifically, the handle now is angled 10 to 15 degrees in the preferred embodiment away from the head portion of the carrier tube when referenced to the horizontal plane created by the shaft portion of the carrier tube. In simpler terms, the handle is no longer perpendicular to the carrier tube but instead resides at a slight angle away from the completely horizontal plane defined by the carrier tube shaft portion. The purpose of the angled handle is to provide a user of the present invention with a better oriented and more relaxed wrist position which allows the head portion of the carrier tube to be consistently struck squarely against a hard surface. The angled handle improves the performance of the present invention by reducing the number of raps against the hard surface to an average maximum of two.

Additionally, the present invention sets forth two new designs of the annular segmented support both of which improve considerably over the original one disclosed in my U.S. Pat. No. 3,646,661. The first design is similar to that disclosed in my prior U.S. Pat. No. 3,646,661 and comprises a plurality of segments, three in the preferred embodiment, connected together using a flexible O-ring. However, unlike my prior design, the O-ring in the present invention is permanently affixed to the plurality of segments using any conventional adhesive such as glue and is completely severed at one spot so that it no longer forms a continuous ring. The O-ring is permanently affixed to the plurality of segments in order to keep them all connected together, nevertheless, it is split to prevent the segments from being continuously forced radially inward.

The second design comprises two segments which are similar to the segments disclosed in my prior U.S. Pat. No. 3,646,661, however, the ends of the two segments are shaved so that they protrude less than the center. For use with rifle cartridges, the two segments are connected together with an O-ring, but for use with pistol cartridges, the O-ring is removed and the two segments are left unconnected. The segment ends are shaved so that uniform pressure in a radially inward direction will be applied to the segment centers by the securing cap as it is threadably attached to the carrier tube. A uniform pressure is necessary to ensure that the segments move squarely as they engage the casing cannelure Square and uniform movement of the two segments as they engage the casing cannelure allows them to grasp the cannelure along the greatest surface area. If the ends of the segments were not reduced, the segments would engage the cannelure only at their ends, thereby, permitting many of the cartridges to pass through the segments after the carrier tube was struck against a hard surface.

Both designs present a significant improvement over my old design because they permit the bullet to be removed after separation from the casing without first having to unscrew the securing cap attached to the end of the carrier tube. The first design allows passage of the bullet because the segment ends which remain unconnected as a result of the severed O-ring open sufficiently far to allow the bullet to pass when the carrier tube is shook or the securing cap is rapped against a hard surface. Similarly, the second design allows passage of the bullet because due to the use of only two segments there will always be an opening between the two segments, even in their most closed position, which is sufficiently large to allow the bullet to pass when the carrier tube is shook or the securing cap is rapped against a hard surface.

It is, therefore, an object of the present invention to provide an inertial bullet puller which has an angled handle that reduces the number of times it must be struck against a hard surface before the bullet is separated from the casing.

It is another object of the present invention to provide an inertial bullet puller with an annular segmented support which allows a bullet separated from its casing to be removed from the carrier tube without first having to remove the securing cap.

Still other features and advantages of the present invention will become evident to those skilled in the art in light of the following.

DETAILED DESCRIPTION OF THE PREFERRED EMBODIMENT

Figure 1:
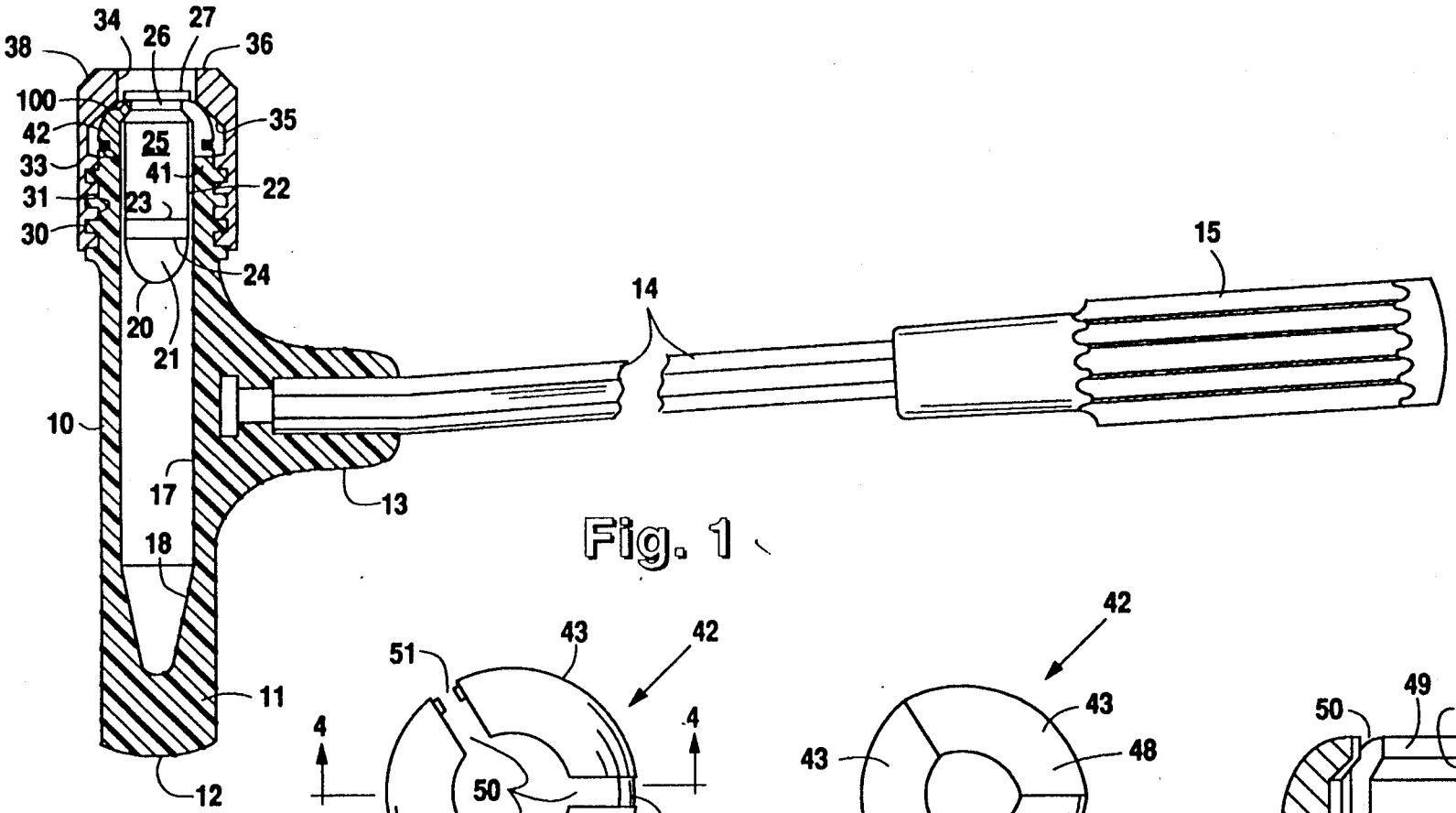
FIG. 1 is a side view partially in cross section showing the inertial bullet puller according to the preferred embodiment of the present invention.
Figure 3:
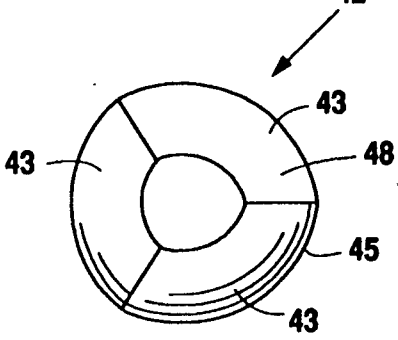
FIG. 3 is a plan view showing the annular segmented support according to the preferred embodiment of the present invention in fully contracted position.

Referring now to the drawings and especially FIG. 1, there is shown an inertial bullet puller including carrier tube 10. Carrier tube 10 is preferably constructed from a generally tubular plastics material member which has an opening at its upper end and a closed lower end 11 providing head portion 12 for striking against a hard surface.

Boss 13 on the side of carrier tube 10 provides a means for making a suitable connection to a, preferably, aluminum steel shaft 14. Fluted plastics material tube 15 forms a handgrip which is suitably secured to shaft 14. Boss 13, shaft 14, and handgrip 15 together form a handle for the carrier. In the preferred embodiment, shaft 14 is angled 10 to 15 degrees away from the horizontal plane defined by boss 13 in a direction away from closed lower end 11. The angle of the handle is provided because it permits a better oriented and more relaxed user wrist position which allows head portion 12 to be squarely struck against a hard surface on a consistent basis.

Figure 2:
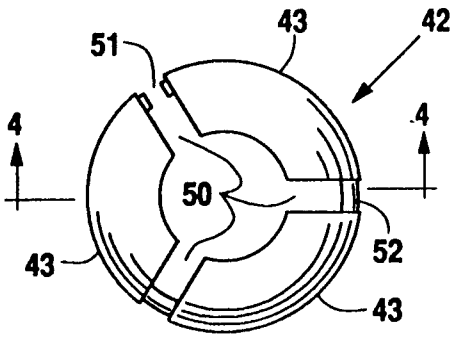
FIG. 2 is a plan view showing the annular segmented support according to the preferred embodiment of the present invention in an expanded position.
Figure 4:
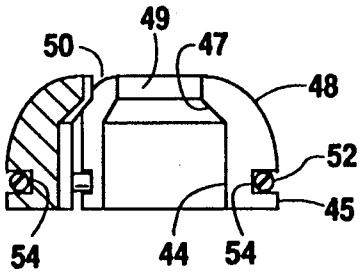
FIG. 4. is a vertical cross section of the annular segmented support according to the preferred embodiment of the present invention.

The diameter of inner surface 17 of carrier tube 10 is slightly larger than the largest cartridge expected to be used in the puller. Lower end 18 of inner surface 17 of carrier tube 10 is preferably tapered to provide a surface tangent to arcuate nose 20 of bullet 21 so as to slowly frictionally arrest the downward travel of bullet 21 when it is freed from its case 22. cylindrical inner upper edge 49 (see FIG. 4). When disposed about the cannelure of a cartridge, as shown in FIG. 1, segments 43 are circumferentially spaced apart, as shown at 50 in FIGS. 2 and 4. Segments 43 are connected together using O-ring 52 which lies permanently affixed within grooves 54, one groove being in each of outer surfaces 45 of segments 43. O-ring 52 is provided only to serve as a connection between segments 43 and does not resiliently urge them inwardly. O-ring 52 produces no elastic force about segments 43 because in the preferred embodiment, it is completely severed at space 51 shown in FIG. 2. No force must be maintained by O-ring 52 because the inward force necessary to urge segments 43 inwardly about a cartridge causing their edges 49 to snugly engage the smallest diameter part of the cannelure, as shown in FIG. 1, may be provided by tightening cap 33 until cam surface 35 of cap 33 engages outer upper surfaces 48 of segments 43. By removing the constant elastic force that would be produced if O-ring 52 were not severed, segments 43 will now allow a bullet separated from its casing to be removed from carrier tube 10 without first having to remove cap 33.

To connect segments 43 together, O-ring 52 is first placed about segments 43 and into their respective grooves 54. Next, O-ring 52 and grooves 54 are coated with an adhesive such as any conventional glue, which is then allowed to dry. Segments 43, which are now held together by O-ring 52, are expanded away from each other and O-ring 52 is severed at spaces 51 shown in FIG. 2, thereby, keeping segments 43 connected together but eliminating the elastic force of O-ring 52.

Figure 5:
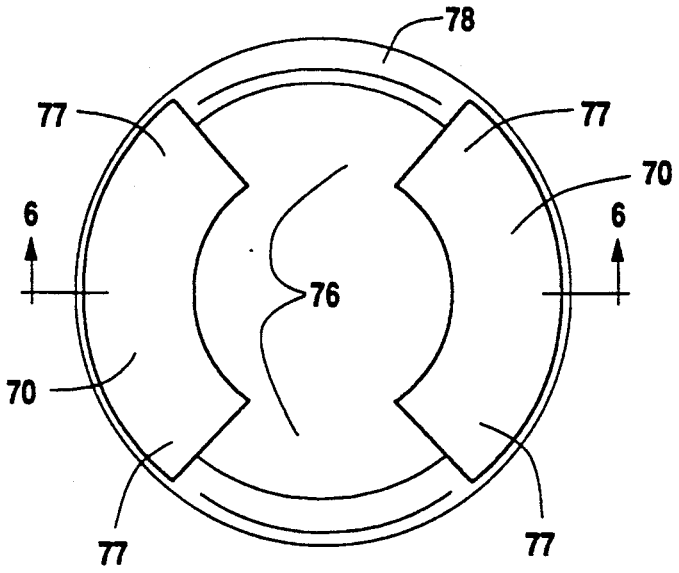
FIG. 5 is a plan view showing the annular segmented support according to the second embodiment of the present invention in an expanded position.
Figure 6:
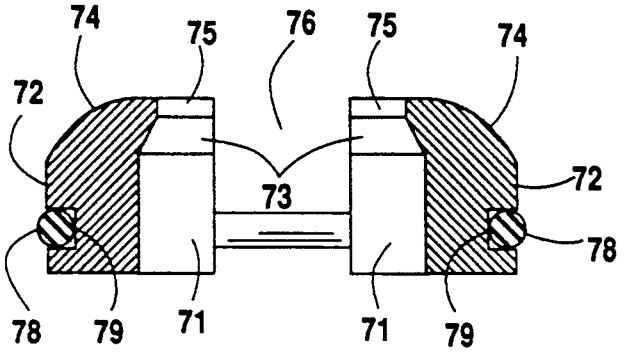
FIG. 6 is a cross sectional side view showing the annular segmented support according to the second embodiment of the present invention.

Referring to FIGS. 5 and 6, a second embodiment of annular segmented support 42 will be described. Annular segmented support 42 in this second embodiment comprises two segments 70. Segments 70 are similar to segments 43 in that each has an arcuate shell having inner and outer generally cylindrical surfaces 71, 72 and conical inner and near spherical curved outer upper surfaces 73, 74, and a cylindrical inner upper edge 75 (see FIG. 6). Additionally, when disposed about the cannelure of a cartridge, as shown in FIG. 1, segments 70 are circumferentially spaced apart, as shown at 76 in FIGS. 5 and 6. However, segments 70, unlike segments 43, have each of their ends 77 shaved to lessen their protrusion so that the centers of curved outer surfaces 74 protrude more than ends 77. Ends 77 are shaved to permit cam surface 35 of cap 33 to engage outer upper surfaces 74 of segments 70 directly in the center of segments 70. Thus, segments 70 are uniformly urged inwardly about a cartridge which causes their edges 75 to snugly engage the smallest diameter part of the cannelure along the largest surface area (see FIG. 1). If a rifle bullet is to separated from its casing, segments 70 are connected together using O-ring 78 which lies within grooves 79, one groove being in each of outer surfaces 72 of segments 70. If a pistol bullet is to be separated from its casing, then O-ring 78 is removed and segments 70 used completely unconnected. In the latter case, segments 70 are held in place by cap 33. Once the bullet has been separated from its casing, it can be removed from carrier tube 10 without the removal of cap 33 because after cap 33 is loosened, the opening between segments 70 will expand to a position sizable enough to permit even the largest caliber bullets to pass.

In operation, the user grasps handgrip 15 and swings the puller to give high speed to carrier tube 10 and strikes head portion 12 at lower end 11 of carrier tube 10 against a hard surface, with carrier tube 10 moving with its axis perpendicular to the surface at the moment of impact. Carrier tube 10 comes to rest and may bounce off of the hard surface. In any event, the upper end of carrier tube 10 comes to rest slightly later than the lower end as determined by the speed of propagation of the elastic shock wave in the plastic of carrier tube 10. The speed of this shock wave will determine the increment of time during which the momentum of the cartridge case is changed from its initial downwardly directed maximum magnitude just prior to impact of the carrier with the hard surface to a zero or upwardly directed magnitude, and this in turn is proportional to the force exerted tending to pull the case and bullet apart. It may be considered that when the shock wave reaches annular segmented support 42 the upwardly moving end of carrier tube 10 pushes segments 43 upwardly relative to the cartridge, and the upper ends of segments 43 bearing against the upper side 100 of the cannelure pull the case from the bullet. The faster the wave moves the faster the upper end of carrier tube 10 moves relative to the cartridge case, or otherwise expressed, the more quickly the case is brought to rest. Thus, carrier tube 10 is preferably made of a material that transmits elastic waves at a high velocity but has a high impact strength so that it will not shatter. A plastics material sold under the trade name "Tennite" (Type 239 A22300M) is a suitable material, having an elastic wave velocity of 6,000 ft./sec. Suitable material may be described as being rigid and tough.

After striking carrier tube head portion 12 once or twice against a hand surface, bullet 21 falls free of cartridge case 22 into the lower part of carrier tube 10. Preferably carrier tube 10 is made of transparent material so that this result can be observed, although the rattling of the loose bullet in carrier tube 10 will make this known by sound and shock in any event.

Cap 33 is then loosened, backing it off sufficiently so that cam surface 35 is spaced axially from top surfaces 48 of segments 43, far enough so that they can expand to free the cartridge case and allow passage of the bullet. Carrier tube 10 is inverted and the cartridge case, bullet, and powder are shaken out of carrier tube 10, with segments 43 expanding under the force of the moving cartridge components. Segments 43 expand amply enough to allow even the largest caliber bullets to be removed without first completely detaching cap 33 because O-ring 52 has been severed at one of the spaces 50 (see FIG. 2). More precisely, as the bullet strikes against inner cylindrical surfaces 44, segments 43 separate at space 51 (see FIG. 2) and allow the bullet to pass out cap opening 34 of cap 33. The bullet passes through segments 43 because O-ring 52 is severed at space 51 and serves only to connect segments 43 together and not to provide a restoring force directed radially inwardly. It is to be noted that inner surfaces 47 of the tops of segments 43 are tapered whereby an axial force exerted on them by the cartridge components causes them to move outwardly against the slight hoop tension created when cam surface 35 of cap 33 abuts inner surfaces 47. The tapering of inner surfaces 47, therefore, provide means for moving segments 43 radially outward.

After carrier tube 10 has been emptied, another cartridge may next be inserted into the top of carrier tube 10 through cap opening 34, the nose of the bullet wedging segments 43 apart as it passes therethrough. Cap 33 is then tightened until cam surface 35 contacts outer surfaces 48 of segments 43, thereby, closing segments 43 about the cannelure. The inertial bullet puller of the present invention is, thus, ready for removal of the bullet from the new cartridge.

It should be apparent to one skilled in the art that the objects of the invention have been realized in the bullet puller embodying the present invention. The annular segmented support is adaptable to a larger range of cannelure diameters and engages the cannelure over a major portion of the circumference thereof. The cap need not be removed between each use of the device and is easily rotated the slight amount needed to tighten and free the annular segmented support.

Figure 7:
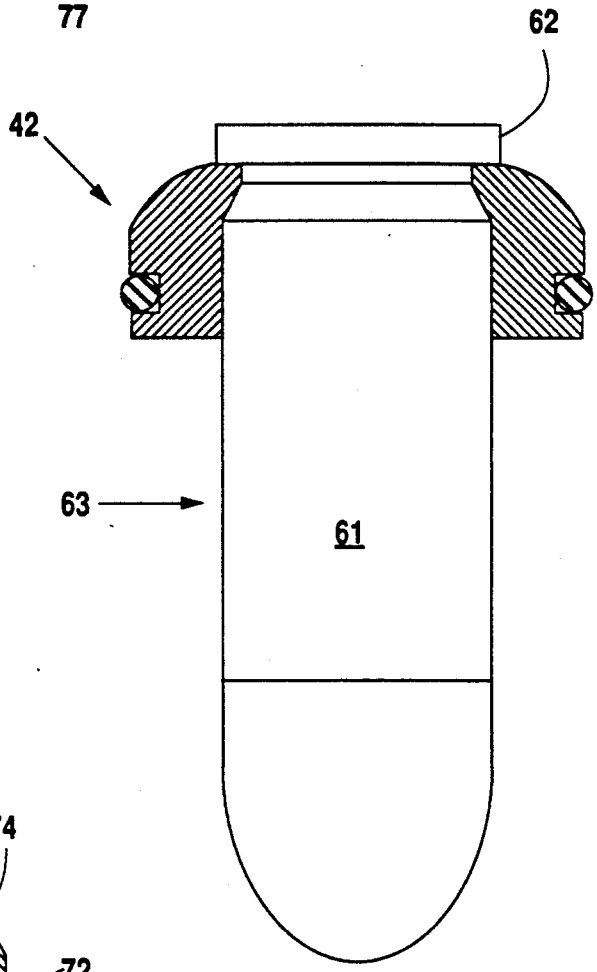
FIG. 7 is a side view in partial cross section showing the annular segmented support engaging a cartridge.

Referring now to FIG. 7, there is shown how annular segmented support 42 can engage the sides of case 61 beneath rim 62 of rimmed cartridge 63. The inertial bullet puller of the present invention is, therefore, suitable for use with all types of cartridge cases e.g., rimmed, semi-rimmed, rimless, rebated, and belted. In each case, annular segmented support 42 is engageable with the sides of the case adjacent the flange at the primer end of the case formed by the rim or the side of the cannelure. Although annular segmented support 42 preferably snugly engages the sides of the case when the cap is screwed down, the important point is that the segments lie underneath, i.e., overlap, the flange to transmit force thereto when the puller is used. Although engagement of the segments with the sides of the case is not essential, it is especially desirable in the situation of a rimmed case in order to prevent the cartridge from accidentally coming out of the puller through the opening 34 in cap 33. Engagement with the sides of the case sufficient to hold the cartridge independently of the flange without marring the case would be possible, however, if the segments engage the case over a sufficiently large area and the case is tapered. In the latter case the inner edges of the segments preferably would be tapered correlative to the cartridge taper and relieved at their upper ends to prevent marring the case. The surfaces of the segments that engage the case are preferably smooth but could be serrated or roughened if it is desired to engage the case more positively.

From the foregoing description and illustration of the present invention, it should be apparent that various modifications can be made by reconfigurations or combinations to produce similar results. It is, therefore, the desire of the applicant not to be bound by the description of the present invention contained in this specification, but to be bound only by the claims as appended hereto.

I claim:

1. A bullet puller, comprising:

a carrier having an opening at its upper end adapted to receive a cartridge and head means at its lower end adapted to be struck against a hard surface;

annular segmented support means;

disposed about said upper end of said carrier arranged to form a collar for engaging said cartridge;

said annular segmented support means comprising a plurality of adjacent segments which are flexibly connected at all but one of their respective adjacent edges, to permit inward and outward movement of said plurality of segments;

means movably mounted over said opening at said upper end of said carrier for forcing said plurality of annular segments radially inward;

handle means connected at one end to said carrier for imparting motion to said carrier for striking it against a hard surface.

2. The bullet puller of claim 1 wherein said means movably mounted over said opening comprise cam means.

3. The bullet puller according to claim 1 wherein said handle means connects at one end to said carrier at an angle not perpendicular to the axis of said carrier to facilitate the striking of said head means squarely against said hard surface.

4. The bullet puller according to claim 1 wherein said segments are provided with tapered surfaces along their inner peripheries to permit the movement of said segments radially outward.

5. The bullet puller according to claim 2 wherein said cam means comprises a cap which engages thread means on said upper end of said carrier, said cap having a cam surface on its interior adapted to engage said segments.

6. The bullet puller according to claim 5 wherein said cap further provides means for retaining said segments on said upper end of said carrier.

7. The bullet puller according to claim 1 wherein said carrier is a tube closed at its lower end.

8. The bullet puller according to claim 3 wherein said handle means comprises a metal shaft having a fluted handgrip mounted on the end opposite from said carrier.

9. The bullet puller according to claim 7 wherein said carrier tube comprises a rigid, tough plastics material capable of propagating an elastic shock wave therein at a speed on the order of at least 6000 ft./sec.

10. The bullet puller of claim 4 wherein said plurality of annular segments are connected by means of a flexible O-ring affixed within outer peripheral grooves formed in said segments, said O-ring being severed between one pair of said adjacent segments.

* * * * *